US006170569B1

(12) United States Patent
Dienhart et al.

(10) Patent No.: US 6,170,569 B1
(45) Date of Patent: Jan. 9, 2001

(54) INTAKE PLENUM UNIT FOR A HEAT EXCHANGER

(75) Inventors: Bernd Dienhart, Köln; Hans-Joachim Krauss, Stuttgart; Hagen Mittelstrass, Bondorf; Jochen Schumm, Stuttgart; Karl-Heinz Staffa, Stuttgart; Christopher Walter, Stuttgart, all of (DE)

(73) Assignee: Behr GmbH & Co., Stuttgart (DE)

( * ) Notice: Under 35 U.S.C. 154(b), the term of this patent shall be extended for 0 days.

(21) Appl. No.: 09/414,649

(22) Filed: Oct. 8, 1999

(30) Foreign Application Priority Data

Oct. 8, 1998 (DE) ..... 198 46 267

(51) Int. Cl.[7] ..... F28F 1/10

(52) U.S. Cl. ..... 165/173; 165/175; 165/153; 165/148

(58) Field of Search ..... 165/152, 153, 165/140, 173, 178; 29/890.043, 890.054

(56) References Cited

U.S. PATENT DOCUMENTS

| | | | | |
|---|---|---|---|---|
| 3,016,230 | | 1/1962 | Cederstrom et al. . | |
| 3,265,126 | | 8/1966 | Donaldson . | |
| 4,175,308 | * | 11/1979 | Togashi | 165/178 |
| 4,546,824 | * | 10/1985 | Melnky | 165/153 |
| 5,052,477 | * | 10/1991 | Nakajima et al. | 165/153 |
| 5,099,576 | * | 3/1992 | Shinmura | 29/890.049 |
| 5,275,236 | * | 1/1994 | Le Gauyer | 165/178 |
| 5,535,819 | | 7/1996 | Matsuura . | |
| 5,579,832 | * | 12/1996 | Le Gauyer | 165/173 |
| 5,749,412 | * | 5/1998 | Balthazard | 165/153 |
| 5,836,384 | * | 11/1998 | Wijkstrom et al. | 165/173 |
| 6,012,512 | * | 1/2000 | Ghiani | 165/140 |

FOREIGN PATENT DOCUMENTS

| | | |
|---|---|---|
| 1 277 282 | 9/1968 | (DE) . |
| 1 451 258 | 3/1969 | (DE) . |
| 195 43 986 | 5/1997 | (DE) . |
| 197 22 098 | 9/1998 | (DE) . |
| 0 576 725 | 1/1994 | (EP) . |
| 0 775 884 A2 | 5/1997 | (EP) . |
| 0 845 647 | 6/1998 | (EP) . |
| 2134147 | 12/1972 | (FR) . |

* cited by examiner

*Primary Examiner*—Ira S. Lazarus
*Assistant Examiner*—Terrell McKinnon
(74) *Attorney, Agent, or Firm*—Evenson, McKeown, Edwards & Lenahan, P.L.L.C.

(57) ABSTRACT

An intake plenum unit is provided for a heat exchanger with a tube block made of a plurality of heat exchanger tubes. The heat exchanger incorporates an intake plenum with a tube wall in which a lengthwise slot is provided for receiving ends of the heat exchanger tubes. The intake plenum is made of one or more individual tubes inserted into one another endwise or fitted together. Each intake plenum has, at least at one individual tube end, a lengthwise slot that is open and made before or after the construction of the intake plenum. This allows problem-free compensation for manufacturing tolerances of the tube ends to be fitted into the lengthwise slot regarding their length in the direction of the lengthwise slot. The intake plenum unit is suitable for use, for example, for gas coolers and evaporators of carbon-dioxide air conditioners.

28 Claims, 3 Drawing Sheets

INTAKE PLENUM UNIT FOR A HEAT EXCHANGER

This application claims the priority of German application 198 46 267.0, filed Oct. 8, 1998, the disclosure of which is expressly incorporated by reference herein.

BACKGROUND AND SUMMARY OF THE INVENTION

The present invention relates to an intake plenum unit for a heat exchanger with a tube block made of a plurality of heat exchanger tubes, with the intake plenum unit having a intake plenum with a tube wall which has a common lengthwise slot provided for ends of the heat exchanger tubes to be inserted therein.

An intake plenum unit of this kind is known from EP 0 845 647 A1. In that intake plenum, a lengthwise slot is provided, axially delimited on both sides, into which slot the ends of straight flat tubes of a tube/fin block, twisted by 90 degrees, are inserted in succession in a fluid-tight manner. Because of manufacturing tolerances, especially relating to the width of the flat tubes and hence the length of the twisted tube ends to be inserted therein, this length being parallel to the lengthwise slot of the intake plenum, problems can occur when the tube ends are inserted into the lengthwise slot. For example, if the width of most of the flat tubes in the tube/fin block is at the upper tolerance limit or even exceeds this limit, the length of the lengthwise slot for this purpose can barely suffice, so that all of the tube ends can be inserted only with difficulty into the slot. Conversely, the lengthwise slot can turn out to be too long instead, if the width of the flat tube is at the lower tolerance limit or is below the latter, creating the danger of leaks in the lengthwise slot after the inserted tube ends have been soldered tight.

The technical problem solved by this invention is to provide an intake plenum unit of the type recited at the outset in which the ends of the heat exchanger tubes of a tube block, regardless of manufacturing tolerances, can be inserted reliably fluid-tight in a common lengthwise slot of the intake plenum.

The invention solves this problem by providing an intake plenum unit in which the intake plenum is manufactured from one or more tubes inserted into one another endwise or fitted together, with a lengthwise slot that is open at least at one individual tube end before or after the assembly of the intake plenum, in other words terminating axially. The actual usable length of the intake plenum lengthwise slot formed in this manner from one or more single-tube lengthwise slots for inserting the ends of the heat exchanger tubes is not established in advance but is variable over a wide range which is sufficiently wide to compensate for any manufacturing tolerances that appear along the axial length of the inserted tube ends. After all the tube ends have been inserted into the lengthwise slot, it is then possible to proceed in suitable fashion with the remaining part of the lengthwise slot not occupied by inserted tube ends.

For example, this free lengthwise slot portion can be sealed subsequently or at the same time as the brazing-tight of the inserted tube ends, or the intake plenum can be inserted with this free part of the lengthwise slot fitted tightly into a connecting tube. Alternatively, an intake plenum manufactured from several individual tubes, at least at one end, can include an individual tube, closed at the outer end, with the lengthwise slot open only toward the inner end. The slot is able to be fitted together with an adjacent individual tube with its inner end for a variable distance, so that the length of the lengthwise slot is adjustably variable as a result. According to the invention, therefore, the ends of the heat exchanger tubes can be inserted without difficulty into the common lengthwise slot even when the tube ends exhibit significant inaccuracies in manufacture.

According to one feature of the invention, the intake plenum includes a plurality of extruded individual tubes that are closed and have bottoms at the ends. The tubes are fitted together so they abut one another at their ends, with the intake plenum lengthwise slot preferably being added after the individual tubes have been joined together. The tube bottoms connected to one another then form transverse partitions in the intake plenum.

According to another feature of the invention, a lengthwise slot, open axially on both sides, is provided on each individual tube which, in this case, is made by bending a sheet metal part that was preferably previously flat. If necessary, the sheet metal part can be bent into a tube at the same time as the heat exchanger tube ends are inserted, so that the intake plenum, even in the transverse dimension of its lengthwise slot, can be adapted without difficulty to any manufacturing tolerances in the heat exchanger tube ends in this extension direction. In another construction the two marginal surfaces of the sheet metal part that delimit the lengthwise slot are shaped so that they lie parallel to and opposite one another following the bending of the sheet metal part to form the tube, so that they can fit flush against the flat outer surfaces of the inserted heat exchanger tube ends that are parallel to one another, promoting the stability and tightness of the fitted connection.

Another feature of the invention is that the lengthwise slot can be designed as a feedthrough so that the edges of the lengthwise slot have a form that is directed inward or is bent over outward and, in this fashion, can receive the heat exchanger tube ends flexibly and with a spring action when inserted.

Still another feature of the invention is that the intake plenum unit can include a sleeve that can be pushed onto the respective end area of the intake plenum, surrounding the latter, with the end area being slit from the openly terminating lengthwise slot. The sleeve serves to seal off an endwise portion of the lengthwise slot that may remain free after the heat exchanger tube ends are inserted. For this purpose, the sleeve stabilizes the intake plenum during operation against bending under high operating pressures of a heat exchanger medium flowing in the interior. In another construction the sleeve has a lengthwise slot that is open only at its end that is at the front in the pushing-on direction, the slot serving as an insertion slot for one or more heat exchanger tube ends that are inserted into the intake plenum lengthwise slot in the end area in question. In this case, the sleeve can be pushed on in the vicinity of the part of the intake plenum lengthwise slot that is occupied by inserted tube ends. Pushing may occur, for example, until the end stop of the insertion slot contacts a heat exchanger tube end, so that a portion of the intake plenum lengthwise slot that terminates openly and may be left free can always be reliably covered by the sleeve.

Yet another feature of the invention is that the sleeve may have a closed bottom or be designed to be open at that point and can be closed by a lid applied separately. In any event, as a result, the intake plenum can be closed in a fluid-tight manner at the end in question.

A further feature of the invention is that a mounting mandrel and/or a retaining element, for example a retaining flange, can be formed on the sleeve. In this way, following the mounting of the sleeve on the intake plenum, the intake plenum unit, and with it the associated tube block, can be permanently connected by the mounting mandrel or the retaining element with another part in a desired fashion.

Finally, the intake plenum can be made of a plurality of individual tubes, with at least one of the two endwise tubes being closed at its outer end and provided with a lengthwise slot that is open at its inner end. This endwise tube can be fitted together in variable length with the adjacent individual tube. In this way, a lengthwise slot, closed on both sides and with a variably adjustable length, can be provided, with the heat transfer tubes being added before the complete fitting together and locking of the two abovementioned individual tubes.

Advantageous embodiments of the invention are shown in the drawings and described below.

DESCRIPTION OF THE PREFERRED EMBODIMENTS

Figure 1:
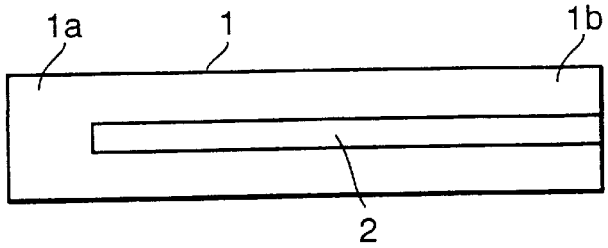
FIG. 1 is a side view of an intake plenum with a lengthwise slot open on one side.

FIG. 1 shows an intake plenum 1 made from a round tube with a tube wall having a lengthwise slot 2 that runs axially. The lengthwise slot 2 is closed in an end area 1*a* of the intake plenum 1, ending there at a distance from the tube end in question, while it terminates openly in end area 1*b* in the other intake plenum.

Figure 2:
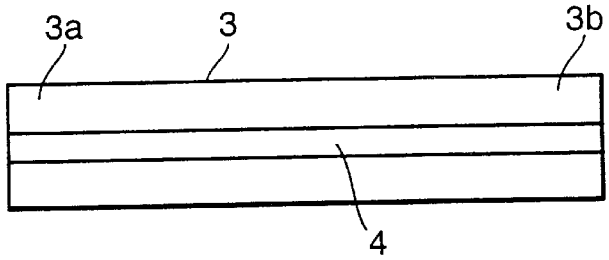
FIG. 2 is a side view of an intake plenum with a lengthwise slot open on both sides.

FIG. 2 shows an intake plenum 3 that has a lengthwise slot 4 running axially which extends all the way through the length of the intake plenum and, therefore, terminates so that it is open at both end areas 3*a*, 3*b* of the intake plenum.

Intake plenum 3 can be manufactured as a continuously slotted tube or alternatively by bending a correspondingly dimensioned sheet-metal strip.

Intake plenums with lengthwise slots open on one or both sides, as shown for example in FIGS. 1 and 2, can be used in intake plenum units for heat exchangers with a tube block made of a plurality of heat exchanger tubes, especially for heat exchangers in which flat tubes with twisted tube ends are used as heat exchanger tubes. An example of such a heat exchanger, like that which can be used for gas coolers or an evaporator of a carbon dioxide air conditioner of a motor vehicle, is shown partially in FIG. 3. This heat exchanger includes a tube/fin block made of a stack of spaced flat tubes 5, between which heat-conducting corrugated fins 6 are inserted. The ends 5*a* of the flat tubes are twisted by 90 degrees relative to the central area of the flat tubes around the lengthwise central axis of the flat tubes, with the stacking interval of the central areas of the flat tubes being made equal to the width of the flat tubes so that the twisted tube ends 5*a* lie side by side in a row in physical contact or at least with a very small distance between them. As a result of being twisted through 90 degrees, the transverse axis of the flat tube in the outer part of the twisted flat tube ends 5*a* is parallel to the stacking direction of the tube/fin block and hence parallel to the lengthwise axis 7 of an intake plenum 8 that runs laterally with respect to the tube/fin block in the stacking direction or vertical direction of the block.

The intake plenum 8 has a common lengthwise slot 9 in its wall for the flat tubes 5, into which slot all of the twisted flat tube ends 5*a* located on this side of the block have been inserted fluid-tight. In particular, intake plenum 8 can be one of the designs shown in FIG. 1 and FIG. 2. In order to seal off the intake plenum 8 in its area at the bottom of FIG. 3 in a fluid-tight manner, in which area the lengthwise slot 9, depending on the design, terminates openly or is closed, a cup-shaped sleeve 10 is provided which is slid onto the end area in question of the intake plenum 8. The bottom of the cup-shaped sleeve 10 closes off the axially open intake plenum 8, and a corresponding side wall area of the sleeve closes off a part of the lengthwise slot 9 that is still free and is not filled by an inserted flat tube end 5*a*. The fluid-tight connection of the sleeve 10 with intake plenum 8 is performed jointly with the fluid-tight connection of the inserted flat tube ends 5*a* with the intake plenum 8 by brazing, for which purpose the intake plenum 8 can be manufactured from plated material appropriate for brazing.

Sleeve 10 can be manufactured by a deep-drawing or extrusion-molding process. As can be seen in the side view in FIG. 4, the sleeve has an insertion slot 11 that opens in the direction in which sleeve 10 is pushed onto intake plenum 8, in other words onto the insertion slot 11 that terminates on the side opposite the sleeve bottom, with which slot 11 the twisted end of the flat tube 5*b* which is lowermost in FIG. 3 comes at least partially into engagement when the sleeve 10 is pushed onto intake plenum 8. For this purpose, the width of the insertion slot 11 essentially corresponds to the thickness of flat tube 5. Depending on the length of sleeve 10 and its insertion slot 11, sleeve 10 in the pushed-on state in this manner surrounds a greater or lesser part of the end of the lowermost flat tube 5*b* that terminates in the intake plenum 8 or, alternatively, surrounds the end of the lowermost flat tube 5*b* and possibly in addition other flat tube ends. The sleeve, therefore, is in a position to compensate for any manufacturing tolerances that develop, in other words independently thereof, to guarantee the required fluid tightness after tight brazing.

Figure 4:
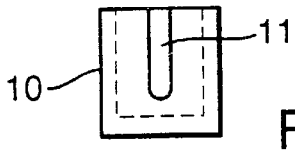
FIG. 4 is a side view of a sleeve used for the intake plenum unit in FIG. 3.
Figure 5:
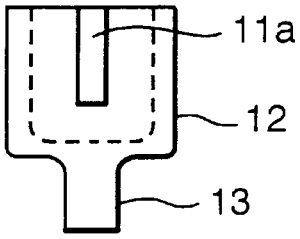
FIG. 5 is a side view of a modified sleeve for the intake plenum unit in FIG. 3.

FIG. 5 shows a side view of sleeve 12 which is different from the one shown in FIG. 4, in which an additional mounting mandrel 13 is formed on the bottom. The mandrel is capable of being used to mount an additional part in a desired fashion on the completely mounted heat exchanger with the sleeve 12 slid onto intake plenum 8 by using a suitable fastener that cooperates with the mounting mandrel 13. In addition, sleeve 12 has an insertion slot 11*a* to receive a matching part of the row of twisted flat tube ends 5*a* inserted into the lengthwise slot 9 of the intake plenum 8.

Figure 3:
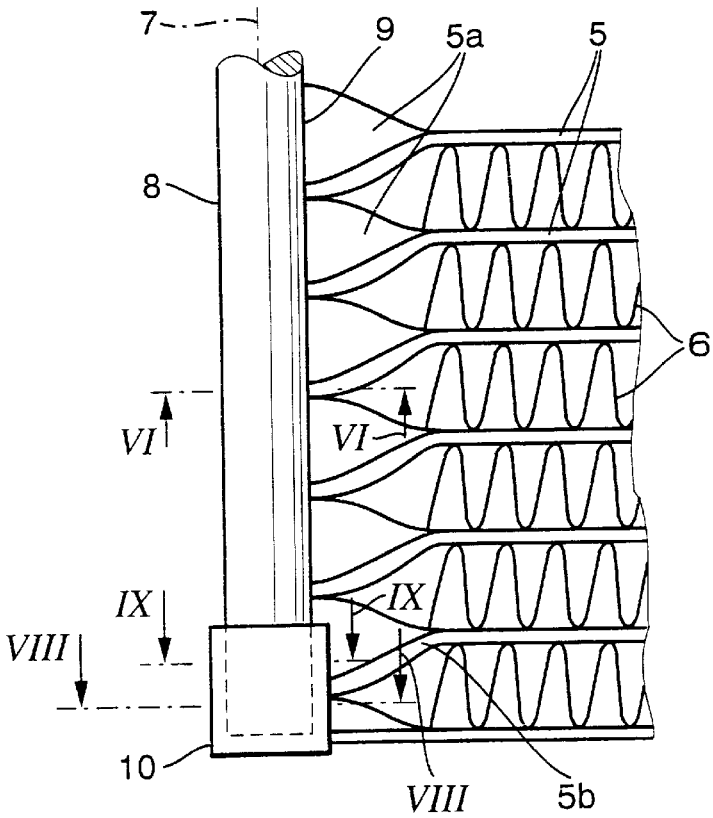
FIG. 3 is a partial top view of a tube/fin block of a heat exchanger with a lateral intake plenum unit.

Because the insertion slot 11 or 11*a* is open on one side, sleeves 10 or 12 can be pushed onto a flat tube end of the intake plenum 8 that is lowermost in FIG. 3 and is fitted to the intake plenum. The slot 9 meets the axial boundary of the insertion slot 11 or 11*a* when the lower end of the intake plenum 8 is against the sleeve bottom. Advantageously the width of insertion slot 11, 11*a* essentially matches the thickness of the flat tube. In those applications in which the sleeve is pushed onto intake plenum 8 only far enough to reach the outermost flat tube end, the insertion slot can be omitted.

When the intake plenum 8 is also closed axially at its end which is not shown in FIG. 3, and/or the lengthwise slot 9 also requires a seal at this point, a second sleeve can be pushed onto this end area of intake plenum 8 in suitable fashion. The respective endwise sleeve not only guarantees the desired tightness but simultaneously prevents bend or gaps in the intake plenum 8 under the influence of pressure during use. This is particularly important for the end area(s) of the intake plenum 8, on which the intake plenum lengthwise slot 9 terminates openly.

Figure 6:
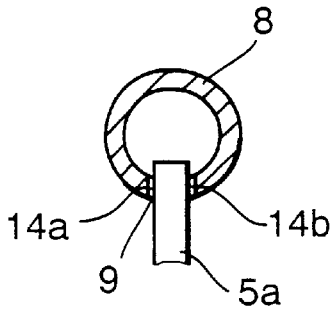
FIG. 6 is a cross section along line VI—VI in FIG. 3.
Figure 7:
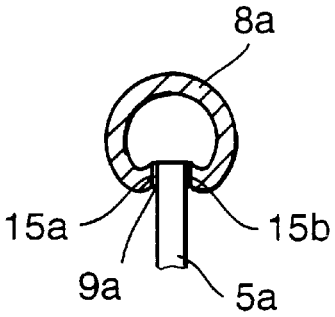
FIG. 7 is a cross section corresponding to FIG. 6, but for an intake plenum with a lengthwise slot designed as a feedthrough.

For good stability and tightness of the connection between the flat tube ends 5*a* fitted into the intake plenum lengthwise slot 9 it is helpful if the edges of the lengthwise slot 9 form guide surfaces for the inserted tube ends 5*a*, fitting flush against them. Designs that are advantageous from this standpoint are illustrated in FIGS. 6 and 7. FIG. 6 shows a version which is especially suitable when the intake plenum 8 is manufactured by bending a sheet-metal strip to make it round. In this version, the two marginal surfaces 14*a*, 14*b* that delimit the lengthwise slot 9 are located parallel to one another at a distance which is equal to or slightly greater than the thickness of the inserted flat tube ends 5*a*. When the intake plenum 8 is made from a flat sheet-metal strip, its two marginal areas that delimit the lengthwise slot are given a suitable shape, preferably before the sheet-metal strip is bent, so that after bending, they are located opposite one another at the required distance, parallel, and not inclined with respect to one another.

FIG. 7 shows a version in which a modified intake plenum 8*a* is provided with a lengthwise slot 9*a* designed as a feedthrough, with the edges 15*a*, 15*b* of the intake plenum wall that delimit the lengthwise slot bent radially and, as a result, forming a flexible mount for the inserted flat tube ends 5*a*. The edges, as illustrated, are bent inward, but may otherwise be bent outward. The bent edges 15*a*, 15*b* are located at a distance from one another that is equal to or slightly less than the thickness of the flat tubes 5*a*. Intake plenum 8*a* in this case acts as a spring which, when the flat tube ends 5*a* are inserted, expands slightly and then holds the inserted flat tube ends 5*a* flexibly. This facilitates assembly, especially when the entire tube/fin block and the one or more lateral intake plenum units composed of the intake plenum 8 and the sleeve 10 are initially preassembled loosely and then brazed to form a solid heat exchanger structure in a joint brazing process. At the same time, by designing the lengthwise slot as a feedthrough, manufacturing tolerances in the thickness of flat tubes 5*a* can be compensated to a certain degree.

Figure 8:
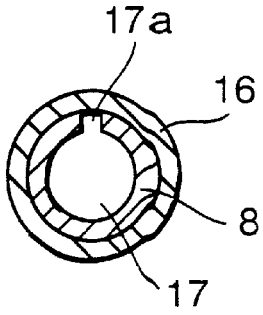
FIG. 8 is a cross section along line VIII—VIII in FIG. 3, but with a modified sleeve.

FIG. 8 shows another version of the sleeve design, in which a sleeve ring 16 that is open axially on both sides is pushed onto intake plenum 8. Intake plenum 8 in this example is closed off endwise by a circular blank 17 that functions as a lid and has a nose 17*a*, which provides for the fluid-tight closure of the otherwise open lengthwise slot 9. Clearly, as in the other sleeve designs, the inside diameter of sleeve ring 16 essentially corresponds to the outside diameter of the intake plenum 8.

Figure 9:
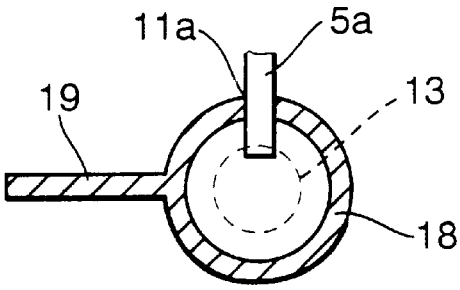
FIG. 9 is a cross section along line IX—IX in FIG. 3, but for another sleeve design.

FIG. 9 shows another version of a sleeve 18 that corresponds to the sleeve 12 in FIG. 5 with the exception that, in addition to the mounting mandrel 13 and the insertion slot 11*a* for a flat tube 5*a* to be received therein, a mounting flange 19 that projects radially outward is provided, by which the completely assembled heat exchanger can be attached in desired fashion to a corresponding part, additionally or alternatively to mounting a corresponding part on mounting mandrel 13.

Figure 10:
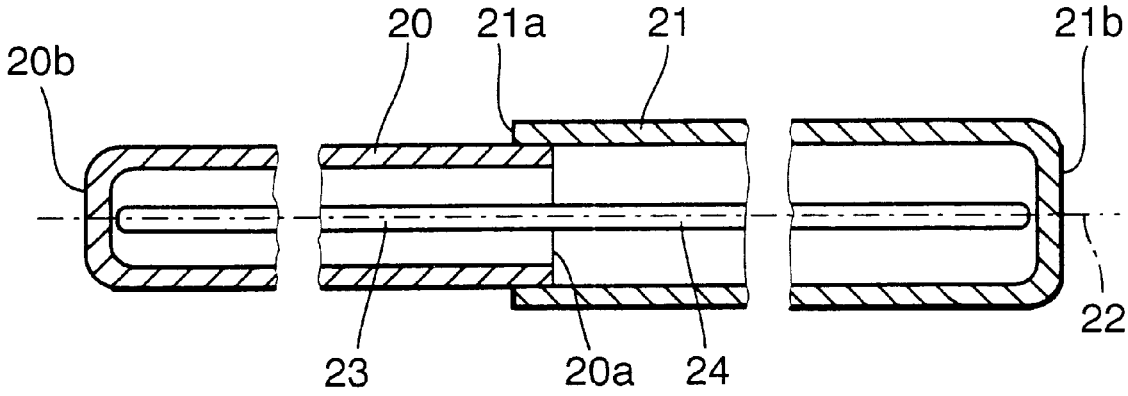
FIG. 10 is a lengthwise section of an intake plenum made from two individual tubes with a lengthwise slot that is closed on both sides and is variably adjustable.

FIG. 10 shows an embodiment of an intake plenum built from two individual tubes 20, 21 inserted into one another. The outside diameter of the tube 20 with the smaller diameter is essentially the same as the inside diameter of the tube 21 with a larger diameter, so that the former can be inserted into the latter with coincident lengthwise axes 22 up to a desired depth and then fluid-tightly connected with the latter, for example by brazing. The two individual tubes 20, 21 are open only at their ends 20*a*, 21*a* inserted into one another while the outer ends 20*b*, 21*b* are closed by a bottom. Each of these tubes, for example, can be manufactured as a tube that is initially open at both ends and is then closed at one end by rolling.

A lengthwise slot 23, 24 is made in both tubes 20, 21. The slot is closed at the outer tube ends 20*b*, 21*b* so that it ends at a distance from the tube bottom there, and is open at the opposite inner tube ends 20*a*, 21*a*. During formation of the intake plenum, the two tubes 20, 21, as shown, are assembled with flush lengthwise slots 23, 24, so that the two lengthwise slots 23, 24 together form an intake plenum lengthwise slot closed on both sides. Its length is variably adjustable, with the two tubes being pushed into one another to a greater or lesser degree. To produce the heat exchanger, initially the two individual tubes 20, 21 are inserted only slightly into one another, after which the ends of the heat exchanger tubes are inserted loosely into the intake plenum lengthwise slot that is still sufficiently long. In order for the length of the lengthwise slot to be sufficient in each case, a length of approximately 0.6 to 0.8 times the block length of the tube block in the vertical direction is advantageously chosen for the two individual tubes 20, 21. As soon as all the heat exchanger tubes have been inserted, the two individual tubes 20, 21 are pushed together completely until they abut the inserted heat exchanger tube ends and the intake plenum lengthwise slot is filled by these tube ends. In this manner, manufacturing tolerances of the ends of the heat exchanger tubes can be compensated without difficulty. The loosely assembled combination is then secured, for example by brazing.

Of course, as a variation of the example shown in FIG. 10, one or more additional individual tubes can be provided between the two individual tubes 20, 21 shown, with each of the additional tubes being provided with a continuous lengthwise slot that terminates at both tube ends. In this case also, the extent of the intake plenum lengthwise slot formed by the lengthwise slots of the individual tubes can be variably adjusted by variable interlocking of at least one outer individual tube in the adjacent individual tube.

Figure 11:
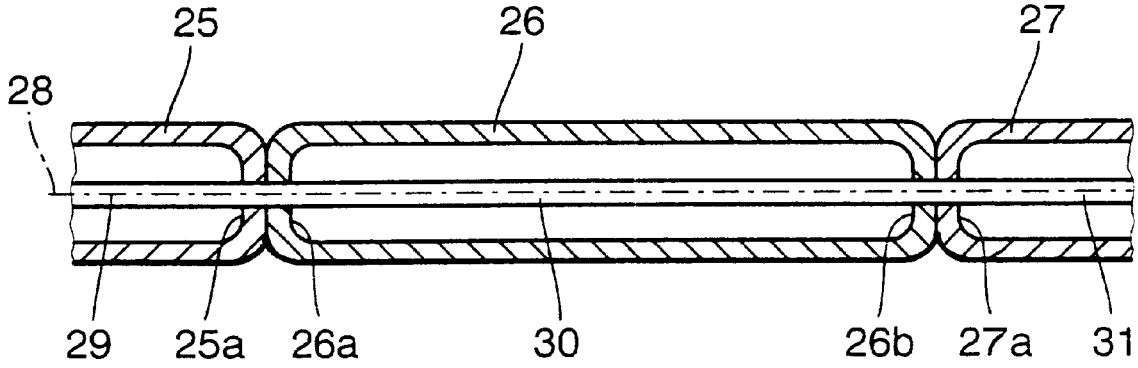
FIG. 11 is a partial lengthwise section of an intake plenum formed from a plurality of individual tubes joined together with closed bottoms.

FIG. 11 shows a portion of another example for producing an intake plenum from a plurality of individual tubes. In this example, for the entire intake plenum or, in any event, for the indicated intake plenum section, a structure made of individual tubes 25, 26, 27 is provided that is closed at both ends by bottoms 25*a*, 26*a*, 26*b*, 27*a*. The individual tubes 25, 26, 27 are provided with continuous lengthwise slots 29, 30, 31 and with abutting bottoms 25*a*, 26*a* and 26*b*, 27*a* and a common lengthwise axis 28 in such fashion that their lengthwise slots 29, 30, 31 are flush and produce a continuous intake plenum lengthwise slot. The individual tubes 25, 26, 27 are preferably made of extrusion-molded blanks that are open on both sides, on which bottoms 25*a*, 26*a*, 26*b*, 27*a* are formed by rolling. At the abutting bottoms 25*a*, 26*a*; 26*b*, 27*a* the individual tubes 25, 26, 27 are permanently connected to one another, with each pair of assembled bottoms 25*a*, 26*a*; 26*b*, 27*a* forming a transverse partition of the intake plenum, so that collecting chambers that are separate and arranged in series in the lengthwise direction of the intake plenum are formed. Corresponding slots are made in bottoms 25*a*, 26*a*, 26*b*, 27*a* by the continuous lengthwise slots 29, 30, 31, which can receive the heat exchanger tube ends to be inserted in this area. Preferably, a ratio of the wall thickness of the tube jackets of the individual tubes 25, 26, 27 to the thickness of the end bottoms 25*a*, 26*a*, 26*b*, 27*a* is approximately 2:1. In this case, the partition thickness corresponds to the tube wall thickness.

The examples shown make clear that the intake plenum unit according to the invention, with a lengthwise slot that is open on at least one side or has a length that can be variable in the intake plenum, makes it possible to construct heat exchangers that are reliably tight even under high operating pressures, with a tube block made of a plurality of heat exchanger tubes, the tubes terminating in an end area in the common lengthwise slot of the intake plenum. Of course, the invention is not limited to the embodiments shown but includes additional ones as well. The invention, for example, includes embodiments in which a connecting tube is connected fluid-tight directly to the end of the intake plenum. In addition, the invention is not limited to the use of straight flat tubes with ends twisted at right angles, but can be used in any construction in which a plurality of heat exchanger tubes terminate endwise in a common lengthwise slot of an intake plenum. Of course, in addition to the round tube type shown, intake plenums with other cross-sectional shapes, such as oval or polygonal cross sections can be used. In all of the embodiments, in addition, one or more partitions can be provided in the intake plenum in order to create a plurality of separate collecting chambers in the intake plenum.

In any case, the invention, by providing a lengthwise slot that is open on at least one side or variably adjustable, and is common to the ends of several corresponding heat exchanger tubes, guarantees problem-free compensation of manufacturing tolerances of the tube ends that are inserted, especially as regards their lengths in the lengthwise direction of this slot.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Intake plenum unit for a heat exchanger with a tube block composed of a plurality of heat exchanger tubes, comprising:

an intake plenum with a wall in which a common lengthwise slot is provided for ends of the heat exchanger tubes inserted therein, wherein said intake plenum is manufactured from an individual tube having said common lengthwise slot which opens at least at one individual tube end and is formed before or after the assembly of the intake plenum; and a sleeve which surrounds the intake plenum and can be pushed endwise onto the intake plenum so as to compensate for any manufacturing tolerances which develop.

2. Intake plenum unit according to claim 1, wherein each individual tube is manufactured with a lengthwise slot and so as to be open at both ends by bending a sheet-metal part.

3. Intake plenum unit according to claim 2, wherein two marginal areas of the sheet-metal part delimit the lengthwise slot and are shaped so that they are located parallel and opposite to one another after the sheet-metal part is bent to form the individual tube.

4. Intake plenum unit according to claim 1, wherein the lengthwise slot is designed as a feedthrough.

5. Intake plenum unit according to claim 1, wherein said sleeve has an insertion slot that is open on one side in a pushing-on direction.

6. Intake plenum unit according to claim 5, and further comprising at least one of a mounting mandrel and a retaining element formed on said sleeve.

7. Intake plenum unit according to claim 6, wherein the sleeve, at an end which is rearward in the pushing-on direction, has a closed bottom.

8. Intake plenum unit according to claim 5, wherein the sleeve, at an end which is rearward in the pushing-on direction, is open, and further comprising a lid which can close the open end.

9. Intake plenum unit for a heat exchanger with a tube block composed of a plurality of heat exchanger tubes, comprising an intake plenum with a wall in which a common lengthwise slot is provided for ends of the heat exchanger tubes inserted therein, wherein said intake plenum is manufactured from a plurality of individual tubes, joined together and respectively having a lengthwise slot which opens at least at one individual tube end and is formed before or after the assembly of the intake plenum, said individual slots together forming said common slot.

10. Intake plenum unit according to claim 9, wherein the individual tubes are extrusion-molded individual tubes with endwise bottoms, wherein the individual tubes are fitted together with bottoms thereof abutting one another, and wherein the individual tubes are provided with continuous flush lengthwise slots.

11. Intake plenum unit according to claim 9, wherein each individual tube is manufactured with a lengthwise slot and so as to be open at both ends by bending a sheet-metal part.

12. Intake plenum unit according to claim 11, wherein two marginal areas of the sheet-metal part delimit the lengthwise slot and are shaped so that they are located parallel and opposite to one another after the sheet-metal part is bent to form the individual tube.

13. Intake plenum unit according to claim 9, wherein the lengthwise slot is designed as a feedthrough.

14. Intake plenum unit according to claim 9, and further comprising a sleeve which surrounds the intake plenum and can be pushed endwise onto the intake plenum.

15. Intake plenum unit according to claim 14, wherein said sleeve has an insertion slot that is open on one side in a pushing-on direction.

16. Intake plenum unit according to claim 15, wherein the sleeve, at an end which is rearward in the pushing-on direction, has a closed bottom.

17. Intake plenum unit according to claim 14, and further comprising at least one of a mounting mandrel and a retaining element formed on said sleeve.

18. Intake plenum unit according to claim 15, wherein the sleeve, at an end which is rearward in the pushing-on direction, is open, and further comprising a lid which can close the open end.

19. Intake plenum unit according to claim 9, and further comprising a blank by which said intake plenum can be closed off, said blank having a nose by which fluid tight closure of said lengthwise slot can be provided.

20. Intake plenum unit for a heat exchanger with a tube block composed of a plurality of heat exchanger tubes, comprising an intake plenum with a wall in which a common lengthwise slot is provided for ends of the heat exchanger tubes inserted therein, wherein said intake plenum is manufactured from a plurality of individual tubes inserted into one another endwise, and respectively having a lengthwise slot which opens at least at one individual tube end and is formed before or after the assembly of the intake plenum, said individual slots together forming said common slot.

21. Intake plenum unit according to claim 20, wherein two marginal areas of a sheet-metal part delimit the lengthwise slot and are shaped so that they are located parallel and opposite to one another after the sheet-metal part is bent to form one of the individual tubes.

22. Intake plenum unit according to claim 20, wherein the lengthwise slot is designed as a feedthrough.

23. Intake plenum unit according to claim 20, wherein the individual tubes include two endwise tubes, and wherein at least one of the two endwise tubes is closed at its outer end, provided with a lengthwise slot that is open only at its inner end, and assembled to an adjacent individual tube.

24. Intake plenum unit according to claim 20, and further comprising a blank by which said intake plenum can be closed off, said blank having a nose by which fluid tight closure of said lengthwise slot can be provided.

25. Intake plenum unit for a heat exchanger with a tube block composed of a plurality of heat exchanger tubes, comprising:

an intake plenum with a wall in which a common lengthwise slot is provided for ends of the heat exchanger tubes inserted therein, wherein said intake plenum is manufactured from an individual tube having said common lengthwise slot which opens at least at one individual tube end and is formed before or after the assembly of the intake plenum; and a blank by which said intake plenum can be closed off, said blank having a nose by which fluid-tight closure of said lengthwise slot can be provided.

26. Intake plenum unit according to claim 25, wherein each individual tube is manufactured with a lengthwise slot and so as to be open at both ends by bending a sheet-metal part.

27. Intake plenum unit according to claim 26, wherein two marginal areas of the sheet-metal part delimit the lengthwise slot and are shaped so that they are located parallel and opposite to one another after the sheet-metal part is bent to form the individual tube.

28. Intake plenum unit according to claim 25, wherein the lengthwise slot is designed as a feedthrough.

* * * * *